US007646350B2

(12) United States Patent
Chuang et al.

(10) Patent No.: US 7,646,350 B2
(45) Date of Patent: Jan. 12, 2010

(54) ANTENNA STRUCTURE

(75) Inventors: Ying-Chieh Chuang, Taipei (TW); Ching-Chung Tang, Taipei (TW); Shen-Yuan Lee, Taipei (TW)

(73) Assignee: Asustek Computer Inc., Peitou, Taipei (TW)

( * ) Notice: Subject to any disclaimer, the term of this patent is extended or adjusted under 35 U.S.C. 154(b) by 0 days.

(21) Appl. No.: 12/098,462

(22) Filed: Apr. 7, 2008

(65) Prior Publication Data

US 2008/0252554 A1 Oct. 16, 2008

(30) Foreign Application Priority Data

Apr. 16, 2007 (TW) ..... 96113315 A

(51) Int. Cl.
*H01Q 1/24* (2006.01)

(52) U.S. Cl. ..... 343/702; 343/700 MS

(58) Field of Classification Search ..... 343/700 MS, 343/702, 906

See application file for complete search history.

(56) References Cited

U.S. PATENT DOCUMENTS

| | | | | |
|---|---|---|---|---|
| 6,414,641 | B1 | 7/2002 | Carlson | |
| 6,437,747 | B1 * | 8/2002 | Stoiljkovic et al. | 343/702 |
| 6,512,491 | B2 * | 1/2003 | Kanayama et al. | 343/883 |
| 6,614,405 | B1 * | 9/2003 | Mikkonen et al. | 343/872 |
| 6,882,318 | B2 | 4/2005 | Nevermann | |
| 7,433,720 | B2 * | 10/2008 | Seol | 455/575.1 |
| 2003/0003948 | A1 * | 1/2003 | Dai | 455/550 |

* cited by examiner

*Primary Examiner*—Tho G Phan
(74) *Attorney, Agent, or Firm*—Winston Hsu

(57) ABSTRACT

The present invention provides an antenna structure. The antenna structure includes a main board, at least having a signal feeding portion; a bearing component, connected to the main board and at least having a protrusive portion; and an antenna, connected to the bearing component and at least having a pin portion, wherein the pin portion is disposed on the protrusive portion, and the signal feeding portion and the pin portion contact with each other.

23 Claims, 2 Drawing Sheets

ANTENNA STRUCTURE

BACKGROUND OF THE INVENTION

1. Field of the Invention

The present invention relates to an antenna structure, and more particularly, to an antenna structure that effectively improves the contact situation between an antenna and a main board.

2. Description of the Prior Art

As wireless communication technology becomes more and more popular, antennas have become one of the essential components for many electronic devices, such as mobile phones and global positioning system (GPS) devices. Such electronic device typically has a metal plate spring disposed on a main board of the electronic device. After an antenna is utilized to contact with the metal plate spring, electrical signals received by the antenna can be transmitted to a signal feeding point of the main board through the metal plate spring. Because the metal plate spring has poor elasticity and is prone to deform improperly, however, the contact situation between the antenna and the metal plate spring is often badly, thereby degrading signal receiving ability of the antenna. Therefore, it is desirable to provide an improved antenna connection solution.

SUMMARY OF THE INVENTION

It is therefore one of the objectives of the present invention to provide an antenna structure to solve the above mentioned problems.

The present invention discloses an antenna structure, comprising: a main board, at least having a signal feeding portion; a bearing component, connected to the main board and at least having a protrusive portion; and an antenna, connected to the bearing component and at least having a pin portion, wherein the pin portion is disposed on the protrusive portion, and the signal feeding portion and the pin portion contact with each other.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
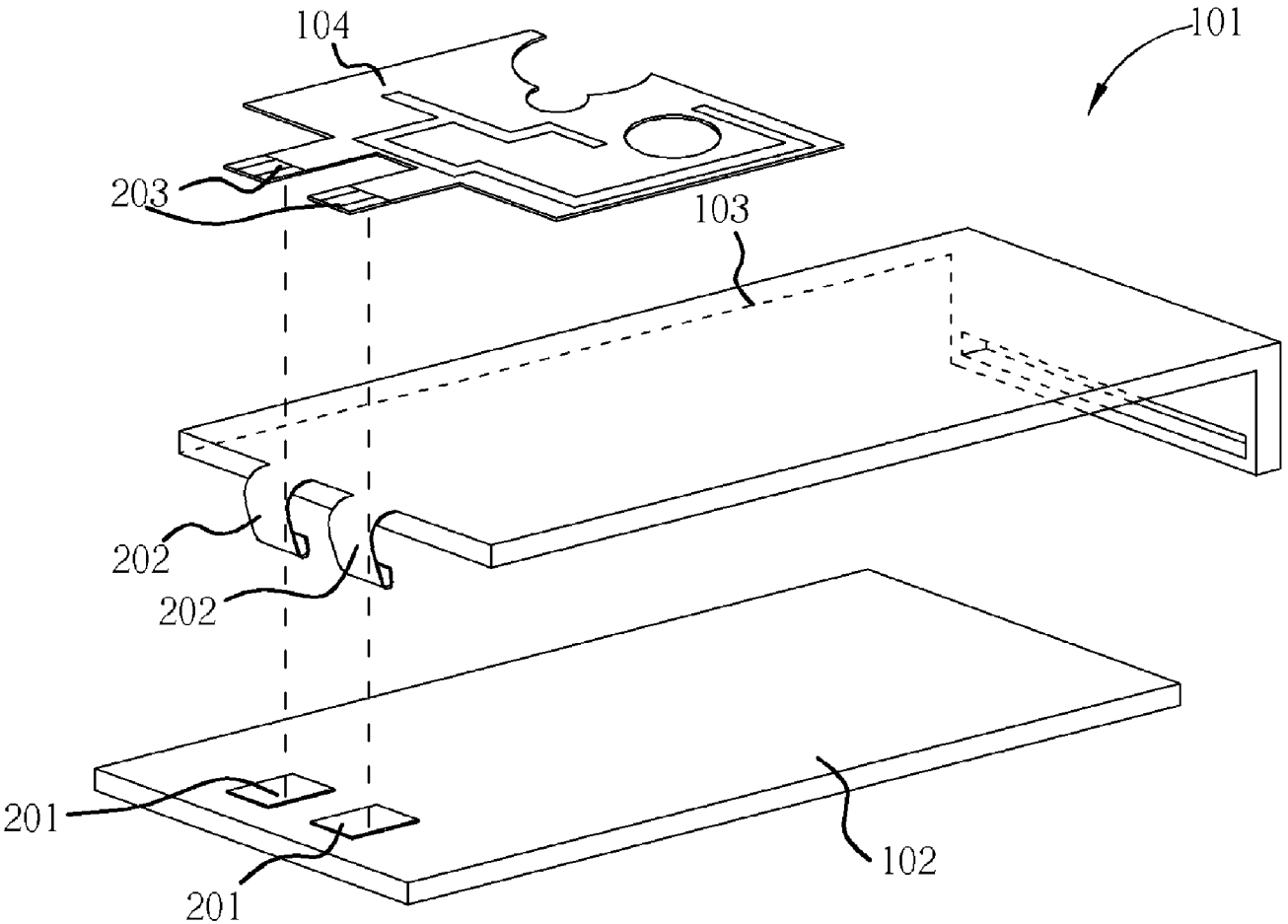
FIG. 1 is an explosive view illustrating an antenna structure according to an embodiment of the present invention.
Figure 2:
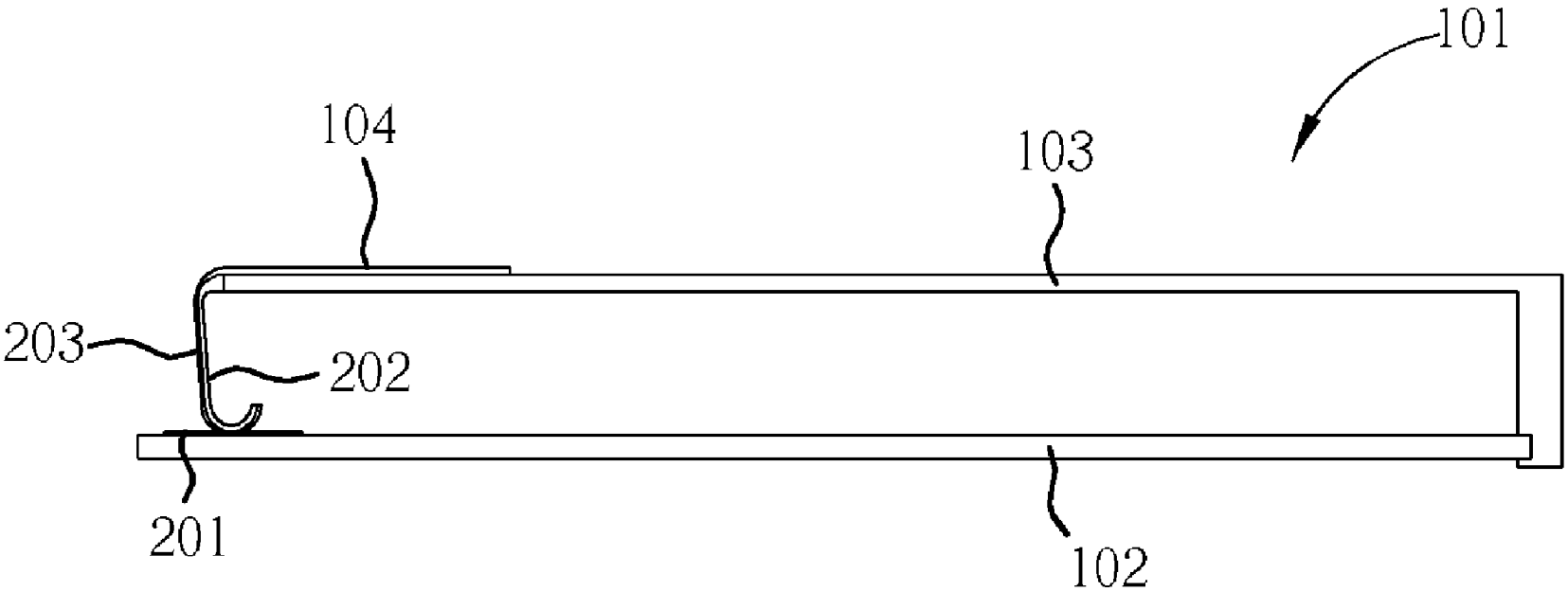
FIG. 2 is a lateral view illustrating an antenna structure in FIG. 1 after assemblage.

FIG. 1 is an explosive view illustrating an antenna structure 101 according to an embodiment of the present invention. FIG. 2 is a lateral view illustrating the antenna structure 101 in FIG. 1 after assemblage. Please refer to both FIG. 1 and FIG. 2 for better understanding the following description.

As shown in FIG. 1, the antenna structure 101 comprises a main board 102, a bearing component 103, and an antenna 104. In this embodiment, the antenna structure 101 is disposed in a mobile phone, the main board 102 is a circuit board of the mobile phone, and the bearing component 103 is an inner cover of the mobile phone. The antenna 104 is a flexible printed circuit (FPC) antenna adhesively connected to the bearing component 103. Additionally, the antenna 104 is a planar inverted-F antenna (PIFA).

The main board 102 has a signal feeding portion 201. The bearing component 103 is connected to the main board 102 and has a protrusive portion 202. The antenna 104 is connected to the bearing component 103 and has a pin portion 203. Additionally, in this embodiment, the bearing component 103 and the main board 102 are engaged with each other, and the antenna 104 is adhesively connected to the bearing component 103. Please note that the above connection style is not meant to be a limitation of the present invention.

The pin portion 203 is disposed on the protrusive portion 202. Additionally, in this embodiment, the pin portion 203 is adhesively connected to the protrusive portion 202 and substantially covers the protrusive portion 202.

In this embodiment, the protrusive portion 202 is made of, for example, elastic plastics. Additionally, the protrusive portion 202 is a hook-shaped protrusion and slightly exceeds the height limit for a corresponding antenna area. Therefore, the protrusive portion 202 deforms properly to make the signal feeding portion 201 and the pin portion 203 contact with each other tightly when the bearing component 103 is connected to the main board 102. In other words, the protrusive portion 202 and the main board 102 interfere with each other when the bearing component 103 is connected to the main board 102. Thus, electrical signals received by the antenna 104 can be transmitted to the signal feeding portion 201 of the main board 102 through the pin portion 203. Additionally, in another possible embodiment, the protrusive portion 202 can also be a plate spring.

In an embodiment of the present invention, since a protrusive portion of a bearing component is elastic and slightly exceeds the height limit for a corresponding antenna area, the protrusive portion of the bearing component deforms properly to make a pin portion of an antenna and a signal feeding portion of a main board contact with each other tightly when the bearing component is connected to the main board by adhesively connecting the pin portion of the antenna to the protrusive portion. Therefore, the contact situation between the antenna and the main board can be greatly improved, thereby upgrading stability and reliability when the antenna and the main board contact with each other. Thus, electrical signals received by the antenna can be effectively transmitted to the signal feeding portion of the main board through the pin portion.

Those skilled in the art will readily observe that numerous modifications and alterations of the device and method may be made while retaining the teachings of the invention.

What is claimed is:

1. An antenna structure, comprising:

a main board, at least having a signal feeding portion;

a bearing component, connected to the main board and at least having a protrusive portion; and an antenna, connected to the bearing component and at least having a pin portion, wherein the pin portion is disposed on the protrusive portion, and the signal feeding portion and the pin portion contact with each other;

wherein the antenna structure is disposed in a mobile phone, the main board is a circuit board of the mobile phone, and the bearing component is an inner cover of the mobile phone.

2. The structure of claim 1, wherein the protrusive portion is elastic, and wherein the protrusive portion deforms properly to make the signal feeding portion and the pin portion contact with each other tightly when the bearing component is connected to the main board.

3. The structure of claim 1, wherein the protrusive portion is made of plastics.

4. The structure of claim 1, wherein the protrusive portion is a hook-shaped protrusion.

5. The structure of claim 1, wherein the protrusive portion is a plate spring.

6. The structure of claim 1, wherein the antenna is a flexible printed circuit (FPC) antenna adhesively connected to the bearing component.

7. The structure of claim 1, wherein the antenna is a planar inverted-F antenna (PIFA).

8. The structure of claim 1, wherein the pin portion is adhesively connected to the protrusive portion.

9. The structure of claim 1, wherein the pin portion covers the protrusive portion.

10. An antenna structure, comprising:

a main board, at least having a signal feeding portion;

a bearing component, connected to the main board and at least having a protrusive portion, wherein the protrusive portion is made of plastics; and an antenna, connected to the bearing component and at least having a pin portion, wherein the pin portion is disposed on the protrusive portion, and the signal feeding portion and the pin portion contact with each other.

11. The structure of claim 10, wherein the protrusive portion is elastic, and wherein the protrusive portion deforms properly to make the signal feeding portion and the pin portion contact with each other tightly when the bearing component is connected to the main board.

12. The structure of claim 10, wherein the protrusive portion is a hook-shaped protrusion.

13. The structure of claim 10, wherein the protrusive portion is a plate spring.

14. The structure of claim 10, wherein the antenna is a flexible printed circuit (FPC) antenna adhesively connected to the bearing component.

15. The structure of claim 10, wherein the antenna is a planar inverted-F antenna (PIFA).

16. The structure of claim 10, wherein the pin portion covers the protrusive portion.

17. An antenna structure, comprising:

a main board, at least having a signal feeding portion;

a bearing component, connected to the main board and at least having a protrusive portion; and an antenna, connected to the bearing component and at least having a pin portion, wherein the pin portion is disposed on the protrusive portion and is adhesively connected to the protrusive portion, and the signal feeding portion and the pin portion contact with each other.

18. The structure of claim 17, wherein the protrusive portion is elastic, and wherein the protrusive portion deforms properly to make the signal feeding portion and the pin portion contact with each other tightly when the bearing component is connected to the main board.

19. The structure of claim 17, wherein the protrusive portion is a hook-shaped protrusion.

20. The structure of claim 17, wherein the protrusive portion is a plate spring.

21. The structure of claim 17, wherein the antenna is a flexible printed circuit (FPC) antenna adhesively connected to the bearing component.

22. The structure of claim 17, wherein the antenna is a planar inverted-F antenna (PIFA).

23. The structure of claim 17, wherein the pin portion covers the protrusive portion.

* * * * *